US007134845B2

(12) United States Patent
Lee et al.

(10) Patent No.: US 7,134,845 B2
(45) Date of Patent: Nov. 14, 2006

(54) VARIABLE CAPACITY ROTARY COMPRESSOR

(75) Inventors: Moon Joo Lee, Suwon (KR); Seung Kap Lee, Suwon (KR); Chun Mo Sung, Hwasung (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 260 days.

(21) Appl. No.: 10/843,303

(22) Filed: May 12, 2004

(65) Prior Publication Data

US 2005/0069441 A1 Mar. 31, 2005

(30) Foreign Application Priority Data

Sep. 30, 2003 (KR) ..... 10-2003-0068055

(51) Int. Cl.
*F04B 49/00* (2006.01)

(52) U.S. Cl. ..... 417/218; 417/221; 417/223; 417/287; 417/410.3; 418/29; 418/60; 418/151

(58) Field of Classification Search ..... 417/218, 417/221, 223, 287, 902, 410.3; 418/69, 151, 418/26, 60, 63
See application file for complete search history.

(56) References Cited

U.S. PATENT DOCUMENTS 6,860,724 B1 * 3/2005 Cho et al. ..... 417/218

FOREIGN PATENT DOCUMENTS

| | | | | |
|---|---|---|---|---|
| JP | 59063393 A | * | 4/1984 | ..... 418/69 |
| JP | 62075092 A | * | 4/1987 | ..... 418/151 |
| JP | 3-124987 | | 5/1991 | |
| JP | 03179192 A | * | 8/1991 | ..... 418/151 |
| JP | 04143483 A | * | 5/1992 | ..... 418/151 |

* cited by examiner

*Primary Examiner*—Theresa Trieu
(74) *Attorney, Agent, or Firm*—Staas & Halsey LLP

(57) ABSTRACT

A variable capacity rotary compressor including a housing to define therein two compression chambers having different capacities, a rotating shaft transmit ting a rotating force from a drive unit to the two compression chambers, two eccentric parts are provided on an outer surface of the rotating shaft to be placed in the two compression chambers, respectively. Two eccentric bushes, having different weights respectively fitted over the eccentric parts to rotate relative to the rotating shaft within predetermined angles, a pair of force transmission parts, provided on opposite sides of the eccentric unit, to receive the rotating force of the rotating shaft so that one of the two eccentric bushes rotates while being eccentric from the rotating shaft and a remaining one of the two eccentric bushes rotates while being released from eccentricity from the rotating shaft, according to a rotating direction of the rotating shaft.

11 Claims, 8 Drawing Sheets

VARIABLE CAPACITY ROTARY COMPRESSOR

CROSS-REFERENCE TO RELATED APPLICATIONS

This application claims the benefit of Korean Patent Application No. 2003-68055, filed Sep. 30, 2003 in the Korean Intellectual Property Office, the disclosure of which is incorporated herein by reference.

BACKGROUND OF THE INVENTION

1. Field of the Invention

The present invention relates, in general, to variable capacity rotary compressors and, more particularly, to a variable capacity rotary compressor which allows an eccentric unit to be stably rotated.

2. Description of the Related Art

Generally, compressors have been used for a variety of refrigeration systems, such as air conditioners or refrigerators operated with a refrigerant sequentially and repeatedly flowing through a refrigeration cycle which includes compression-condensation-expansion-evaporation operations. In the general refrigeration system, the compressor compresses the refrigerant to highly pressurize the refrigerant prior to discharging the highly pressurized refrigerant to a condenser.

Recently, variable capacity compressors have been used in the general refrigeration systems, such as air conditioners or refrigerators, to vary the cooling capacity thereof as desired. Of the various variable capacity compressors, one includes variable capacity rotary compressors. In a variable capacity rotary compressor, a compression operation is executed in only one of first and second compression chambers having different capacities, thus varying compression capacity.

First and second eccentric units are installed in the first and second compression chambers respectively, of the conventional variable capacity rotary compressor. The eccentric units respectively cause first and second rollers, which are placed in the first and second compression chambers, respectively, to occupy eccentric posting from a rotating shaft to thereby execute a compression operation in the respective compression chamber while making a remaining one of the first and second rollers be released from eccentricity to thereby execute an idle operation, according to a rotating direction of the rotating shaft.

Each of the eccentric units includes first and second eccentric bushes and a locking pin. The first and second eccentric bushes are respectively fitted over first and second eccentric parts which are provided on an outer surface of the rotating shaft to be placed in the first and second compression chambers, respectively. The first and second rollers are fitted over the first and second eccentric bushes, respectively. The locking pin is mounted to a predetermined position of the eccentric unit, and causes one of the first and second eccentric bushes to occupy eccentric positions from the rotating shaft while causing a remaining one of the first and second eccentric bushes to be released from the eccentricity from the rotating shaft, when the, rotating shaft is rotated. Thus, the compression operation is executed in only one of the first and second compression chambers, each of which having different capacities, by an operation of the eccentric unit, according to the rotating direction of the rotating shaft, thus varying the compression capacity.

SUMMARY OF THE INVENTION

Accordingly, it is an aspect of the present invention to provide a variable capacity rotary compressor which reduces a tilt of an eccentric unit when compressing a refrigerant.

The above and/or other aspects are achieved by providing a variable capacity rotary compressor, including a housing, a rotating shaft, first and second eccentric parts, an eccentric unit, and a pair of force transmission parts. The housing defines therein first and second compression chambers. The first compression chamber has a first capacity, and the second compression chamber has a second capacity, which is different from the first capacity of the first compression chamber. The rotating shaft transmits a rotating force from a drive unit, which generates the rotating force, to the first and second compression chambers. The first and second eccentric parts are provided on an outer surface of the rotating shaft to be placed in the first and second compression chambers, respectively. The eccentric unit includes first and second eccentric bushes having different weights. The first and second eccentric bushes are fitted over the first and second eccentric parts, respectively, to rotate relative to the rotating shaft within predetermined angles. The pair of force transmission parts are provided on opposite sides of the eccentric unit to receive the rotating force of the rotating shaft so that one of the first and second eccentric bushes rotates while being eccentric from the rotating shaft and a remaining one of the first and second eccentric bushes rotates while being released from eccentricity from the rotating shaft, according to a rotating direction of the rotating shaft. In this case, the pair of force transmission parts are provided to be closer to a center of gravity of the first or second eccentric bush which is heavier, than to a center of gravity of the first or second eccentric bush which is lighter.

A locking slot may be provided around a predetermined portion of the eccentric unit so that opposite ends of the locking slot are placed on the opposite sides of the eccentric unit to serve as the pair of force transmission parts. A locking pin may be projected from the outer surface of the rotating shaft to engage with the locking slot.

The pair of force transmission parts may have axial positions aligned with an axial position of a center of gravity of the eccentric unit.

Further, a through hole may be axially provided along at least one of the first and second eccentric bushes, thus reducing an eccentric weight.

The above and/or other aspects are achieved by providing a variable capacity rotary compressor, including a housing, a rotating shaft, first and second eccentric parts, an eccentric unit, and a through hole. The housing defines therein first and second compression chambers. The first compression chamber has a first capacity, and the second compression chamber has a second capacity which is different from the first capacity of the first compression chamber. The rotating shaft transmits a rotating force from a drive unit which generates the rotating force, to the first and second compression chambers. The first and second eccentric parts are provided on an outer surface of the rotating shaft to be placed in the first and second compression chambers, respectively. The eccentric unit includes first and second eccentric bushes having different weights. The first and second eccentric bushes are fitted over the first and second eccentric parts, respectively, to rotate relative to the rotating shaft within predetermined angles. The through hole is axially provided along the first or second eccentric bush having a higher weight, thus reducing a weight difference between the first and second eccentric bushes.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
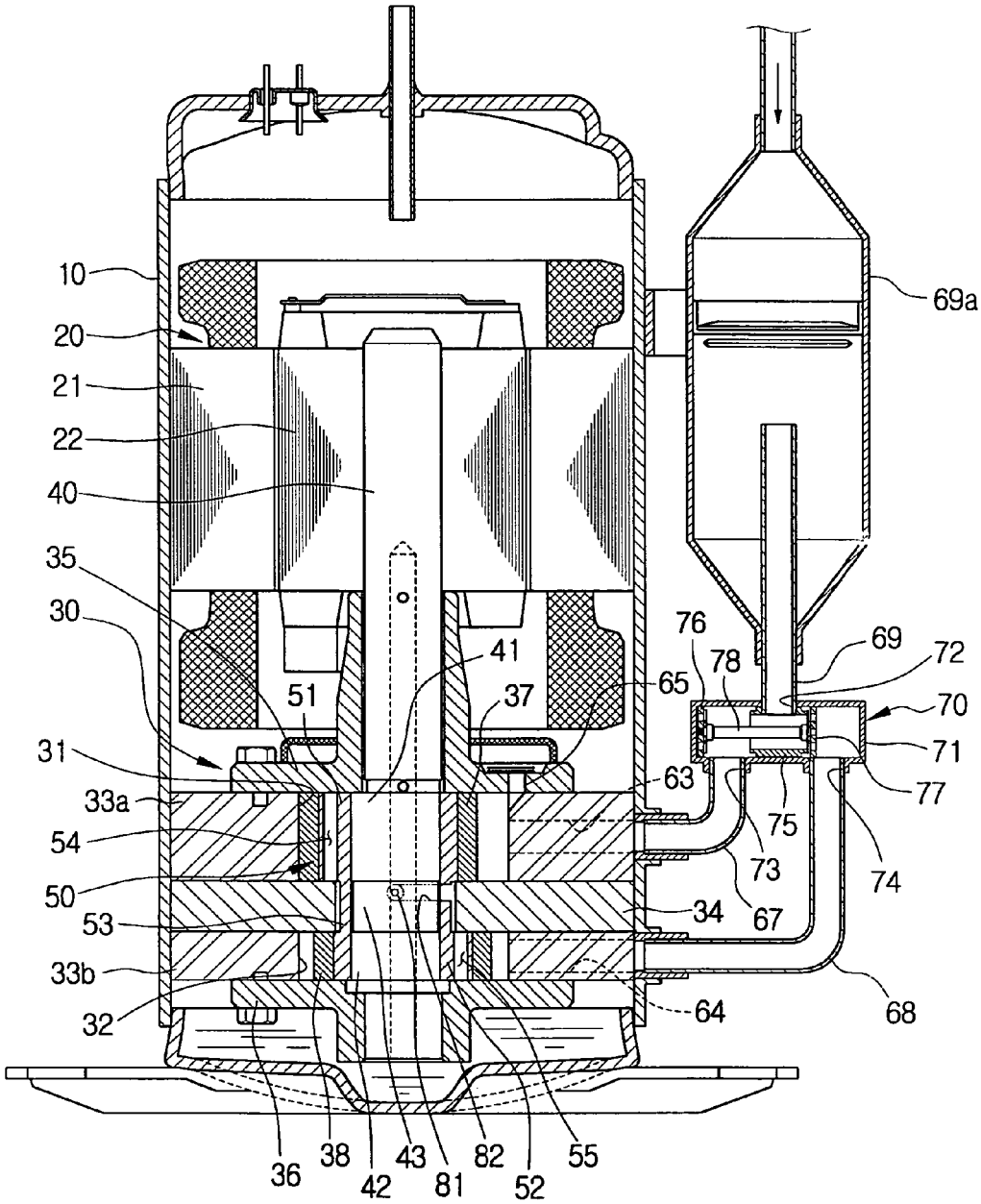
FIG. 1 is a sectional view of a variable capacity rotary compressor, according to a first embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Reference will now be made in detail to the present embodiments of the present invention, examples of which are illustrated in the accompanying drawings, wherein like reference numerals refer to like elements throughout. The embodiments are described below in order to explain the present invention by referring to the figures.

As illustrated in FIG. 1, a variable capacity rotary compressor according to the present invention includes a hermetic casing 10 which defines an external appearance of the compressor, with a drive unit 20 and a compressing unit 30 being installed in the hermetic casing 10. The drive unit 20 is installed on an upper portion of the hermetic casing 10 to generate a rotating force. The compressing unit 30 is installed on a lower portion of the hermetic casing 10 to compress a refrigerant by the rotating force transmitted from the drive unit 20.

The drive unit 20 includes a cylindrical stator 21, a rotor 22, and a rotating shaft 40. The stator 21 is mounted to an inner surface of the casing 10. The rotor 22 is rotatably and concentrically set in the stator 21. The rotating shaft 40 is fixed at a first end thereof to the rotor 22, and passes at a second end thereof through the compressing unit 30. The rotating shaft 40 thus transmits the rotating force from the drive unit 20 to the compressing unit 30. The rotating shaft 40 is rotated in a forward or reverse direction, by changing a direction of an electric current which is supplied to the drive unit 20.

The compressing unit 30 includes upper and lower housing parts 33*a* and 33*b*. The upper and lower housing parts 33*a* and 33*b* respectively define therein first and second compression chambers 31 and 32, which have a cylindrical shape but have different capacities. An upper flange 35 is mounted to an upper surface of the upper housing part 33*a* to close an upper portion of the first compression chamber 31. A lower flange 36 is mounted to a lower surface of the lower housing part 33*b* to close a lower portion of the second compression chamber 32. The upper and lower flanges 35 and 36 also function to rotatably support the rotating shaft 40. Further, a partition plate 34 is interposed between the upper and lower housing parts 33*a* and 33*b* so that the first and second compression chambers 31 and 32 are partitioned from each other.

Figure 2:
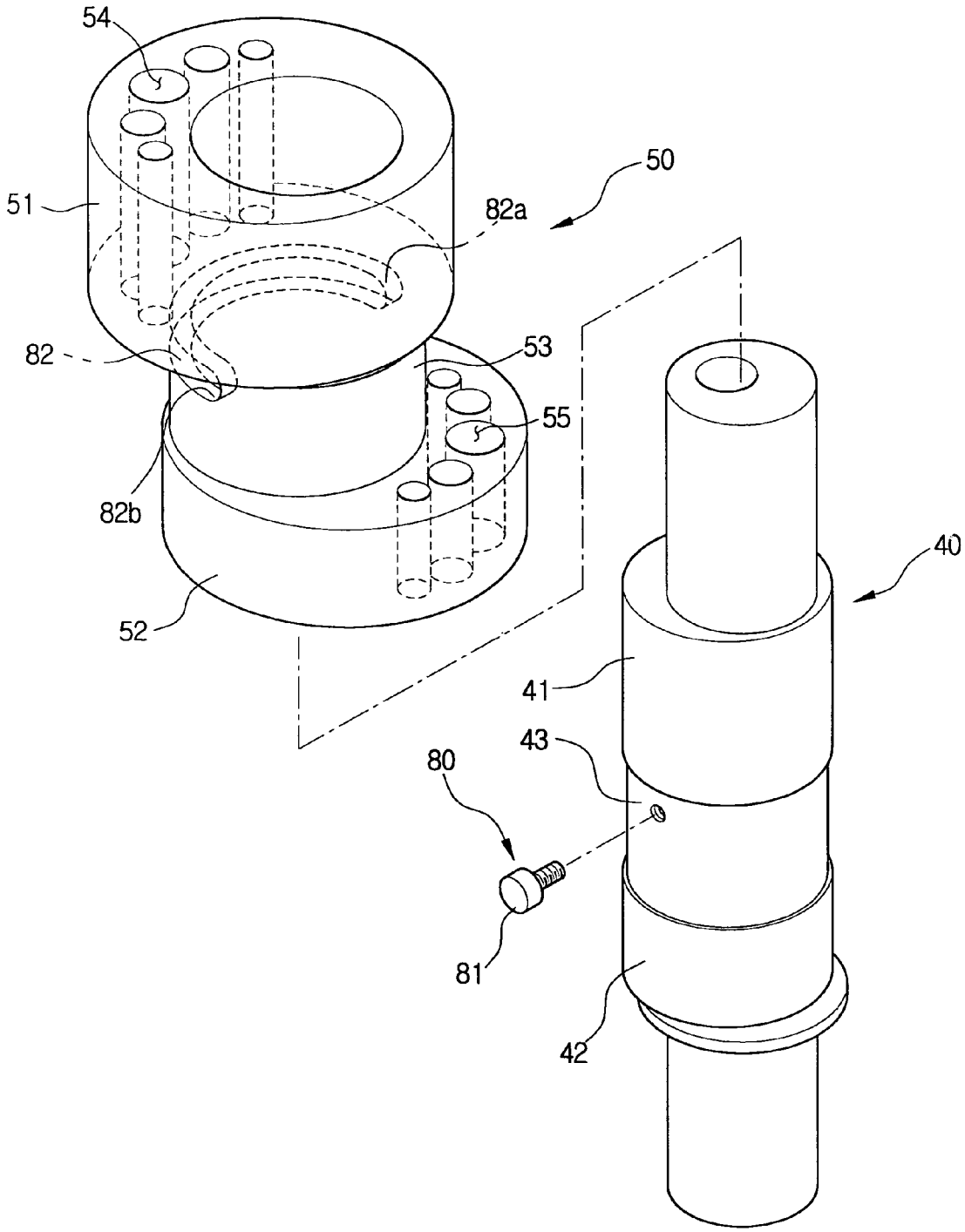
FIG. 2 is a perspective view to illustrate a rotating shaft and an eccentric unit included in the variable capacity rotary compressor of FIG. 1.

As illustrated in FIG. 2, an eccentric unit 50 is provided on the second end of the rotating shaft 40 which is placed in the first and second compression chambers 31 and 32. The eccentric unit 50 functions to compress the refrigerant in either the first or second compression chamber 31 or 32, according to a rotating direction of the rotating shaft 40. First and second rollers 37 and 38 are rotatably fitted over the eccentric unit 50. A first vane 61 is installed between an inlet port 63 and an outlet port 65 of the first compression chamber 31, and reciprocates in a radial direction while being in contact with an outer surface of the first roller 37, thus executing a compression operation. Further, a second vane 62 is installed between an inlet port 64 and an outlet port 66 of the second compression chamber 32, and reciprocates in the radial direction while being in contact with an outer surface of the second roller 38, thus executing the compression operation. The first and second vanes 61 and 62 are biased by first and second vane springs 61*a* and 62*a*, respectively. Further, the inlet and outlet ports 63 and 65 of the first compression chamber 31 are arranged on opposite sides of the first vane 61. Similarly, the inlet and outlet ports 64 and 66 of the second compression chamber 32 are arranged on opposite sides of the second vane 62.

The eccentric unit 50 includes first and second eccentric parts 41 and 42 which are provided on an outer surface of the rotating shaft 40. The first and second eccentric parts 41 and 42 are placed in the first and second compression chambers 31 and 32, respectively, to be eccentric from the rotating shaft 40 in a same direction. First and second eccentric bushes 51 and 52 are rotatably fitted over the first and second eccentric parts 41 and 42, respectively. As illustrated in FIG. 2, the first and second eccentric bushes 51 and 52 are integrally connected to each other by a cylindrical bush connecting part 53, and are eccentric from the rotating shaft 40 in opposite directions. Further, the first and second rollers 37 and 38 are rotatably fitted over the first and second eccentric bushes 51 and 52, respectively.

A plurality of through holes 54 and 55 are respectively provided along the first and second eccentric bushes 51 and 52. The plurality of through holes 54 and 55 serve to reduce weights of eccentric portions of the first and second eccentric bushes 51 and 52, so that centers of gravity C1 and C2 of the first and second eccentric bushes 51 and 52 are adjacent to a rotating axis of the rotating shaft 40, thus allowing the first and second eccentric bushes 51 and 52 to be stably rotated.

Figure 3:
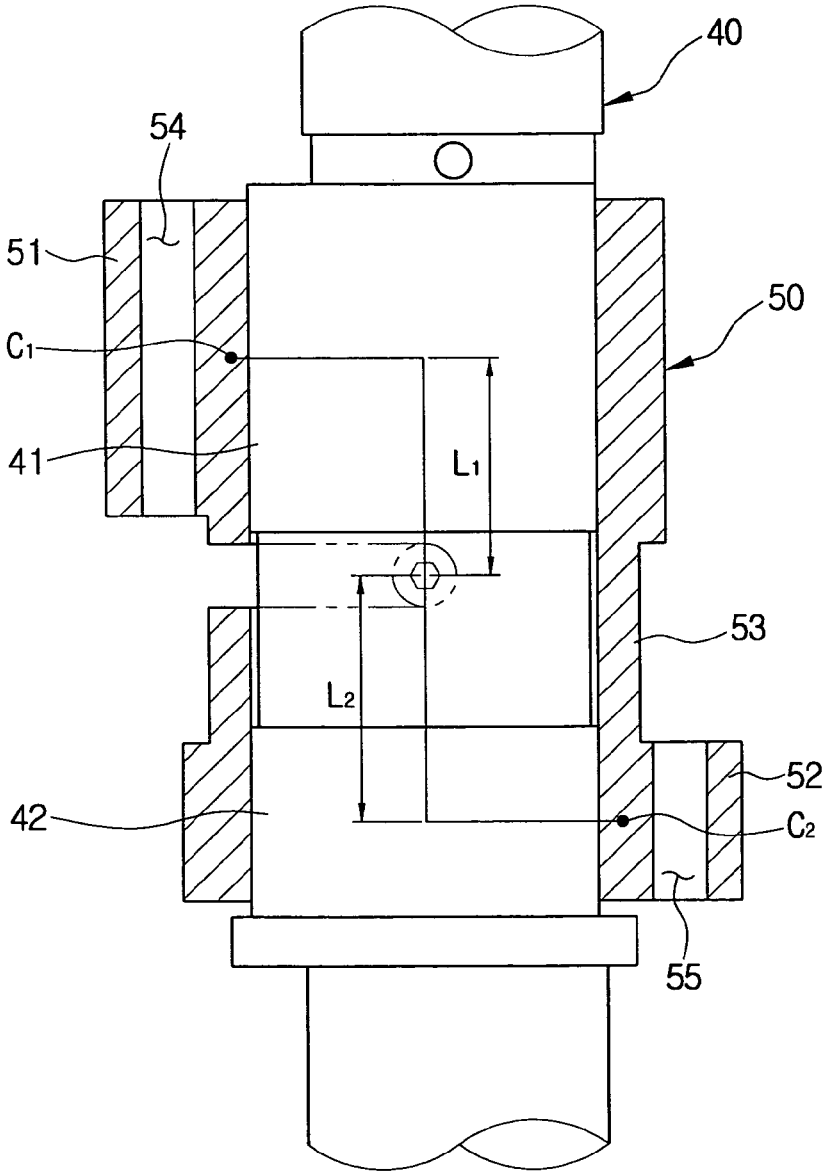
FIG. 3 is a sectional view of the rotating shaft and the eccentric unit included in the variable capacity rotary compressor of FIG. 1.

As illustrated in FIGS. 2 and 3, an eccentric connecting part 43 is provided on the outer surface of the rotating shaft 40 between the first and second eccentric parts 41 and 42 so as to be eccentric from the rotating shaft 40 in the same direction as the first and second eccentric parts 41 and 42. A locking unit 80 is provided in the eccentric connecting part 43. The locking unit 80 makes one of the first and second eccentric bushes 51 and 52 rotate while being eccentric from the rotating shaft 40, and makes a remaining one of the first and second eccentric bushes 51 and 52 rotate while being released from eccentricity from the rotating shaft 40, according to the rotating direction of the rotating shaft 40.

The locking unit 80 includes a locking pin 81 and a locking slot 82. The locking pin 81 is mounted to the eccentric connecting part 43 in a screw fastening method to be projected from a surface of the eccentric connecting part 43. Further, the locking slot 82 is formed around a part of the bush connecting part 53 which connects the first and second eccentric bushes 51 and 52 to each other. The locking pin 81 engages with the locking slot 82 so that one of the first and second eccentric bushes 51 and 52 is eccentric from the rotating shaft 40 while a remaining one of the first and second eccentric bushes 51 and 52 is released from the eccentricity from the rotating shaft 40, according to the rotating direction of the rotating shaft 40. The locking slot 82 is formed so that opposite ends thereof are provided on opposite sides of the eccentric unit 50. The opposite ends of the locking slot 82 receive the rotating force of the rotating shaft 40, according to the rotating direction of the rotating shaft 40, thus serving as first and second force transmission parts 82*a* and 82*b*.

When the locking pin 81, mounted to the eccentric connecting part 43 of the rotating shaft 40, engages with the locking slot 82 of the bush connecting part 53 and the rotating shaft 40 is rotated, the locking pin 81 is rotated within a predetermined range so as to be locked by either of the first and second force transmission parts 82*a* and 82*b* which are respectively provided on the opposite ends of the locking slot 82. Thus, the first and second eccentric bushes 51 and 52 are rotated along with the rotating shaft 40. In a detailed description, when the locking pin 81 is locked by either the first or second force transmission parts 82*a* or 82*b* of the locking slot 82, one of the first and second eccentric bushes 51 and 52 is eccentric from the rotating shaft 40 while a remaining one of the first and second eccentric bushes 51 and 52 is released from the eccentricity from the rotating shaft 40. Thus, the compression operation is executed in one of the first and second compression chambers 31 and 32 while the idle operation is executed in a remaining one of the first and second compression chambers 31 and 32. Meanwhile, when the rotating direction of the rotating shaft 40 is changed, the first and second eccentric bushes 51 and 52 are arranged oppositely to the above-mentioned state.

According to the first embodiment of the present invention, the first and second eccentric bushes 51 and 52 are made of a same material. Thus, the first eccentric bush 51, having a larger volume than the second eccentric bush 52; has a higher weight than the second eccentric bush 52. The locking unit 80 is disposed at a position adjacent to the first eccentric bush 51 having the higher weight than the second eccentric bush 52. Such a construction makes the first and second force transmission parts 82*a* and 82*b* be adjacent to a center of gravity of the eccentric unit 50, thus allowing the eccentric unit 50 to be stably rotated.

In this case, when the first and second force transmission parts 82*a* and 82*b* have axial positions aligned with an axial position of the center of gravity of the eccentric unit 50, a distance between the center of gravity the eccentric unit 50 and the force transmission parts 82*a* and 82*b* is minimized, thus reducing a tilt of the eccentric unit 50 to a minimum. Therefore, in an embodiment of the invention, the center of gravity of the eccentric unit 50 corresponds to the axial positions of the first and second force transmission parts 82*a* and 82*b* so as to reduce the tilt of the eccentric unit 50.

According to the first embodiment of the present invention, a first axial distance L1 between the first and second force transmission parts 82*a* and 82*b* and the center of gravity C1 of the first eccentric bush 51 is shorter than a second axial distance L2 between the first and second force transmission parts 82*a* and 82*b* and the center of gravity C2 of the second eccentric bush 52, thus minimizing the tilt of the eccentric unit 50.

Further, the variable capacity rotary compressor according to the present invention, as illustrated in FIG. 1, includes a path control unit 70. The path control unit 70 controls a refrigerant suction path so that the refrigerant fed from a refrigerant inlet pipe 69 is delivered into either the inlet port 63 of the first compression chamber 31 or the inlet port 64 of the second compression chamber 32. Therefore, the refrigerant is delivered into the inlet port of the compression chamber where the compression operation is executed.

The path control unit 70 includes a cylindrical body 71, and a valve unit which is installed in the body 71. The refrigerant inlet pipe 69 is connected to an inlet 72 which is formed at a central portion of the body 71. First and second outlets 73 and 74 are formed on the body 71 at opposite sides of the inlet 72 to be connected to first and second pipes 67 and 68. The first and second pipes 67 and 68 are connected to the inlet port 63 of the first compression chamber 31 and the inlet port 64 of the second compression chamber 32, respectively. The valve unit which is set in the body 71, includes a cylindrical valve seat 75. The valve seat 75 is installed at a center of the body 71. First and second valve members 76 and 77 are installed at both sides of the body 71, and axially reciprocate in the body 71 to open either end of the valve seat 75. The first and second valve members 76 and 77 are connected to each other by a connecting member 78 to move together. The path control unit 70 constructed as described above is operated as follows. When the compression operation is executed in either the first or second compression chamber 31 or 32, the first and second valve members 76 and 77 are moved toward the first or second outlet 73 or 74 which has a lower pressure, due to a pressure difference between the first and second outlets 73 and 74, thus automatically changing the refrigerant suction path.

Figure 8:
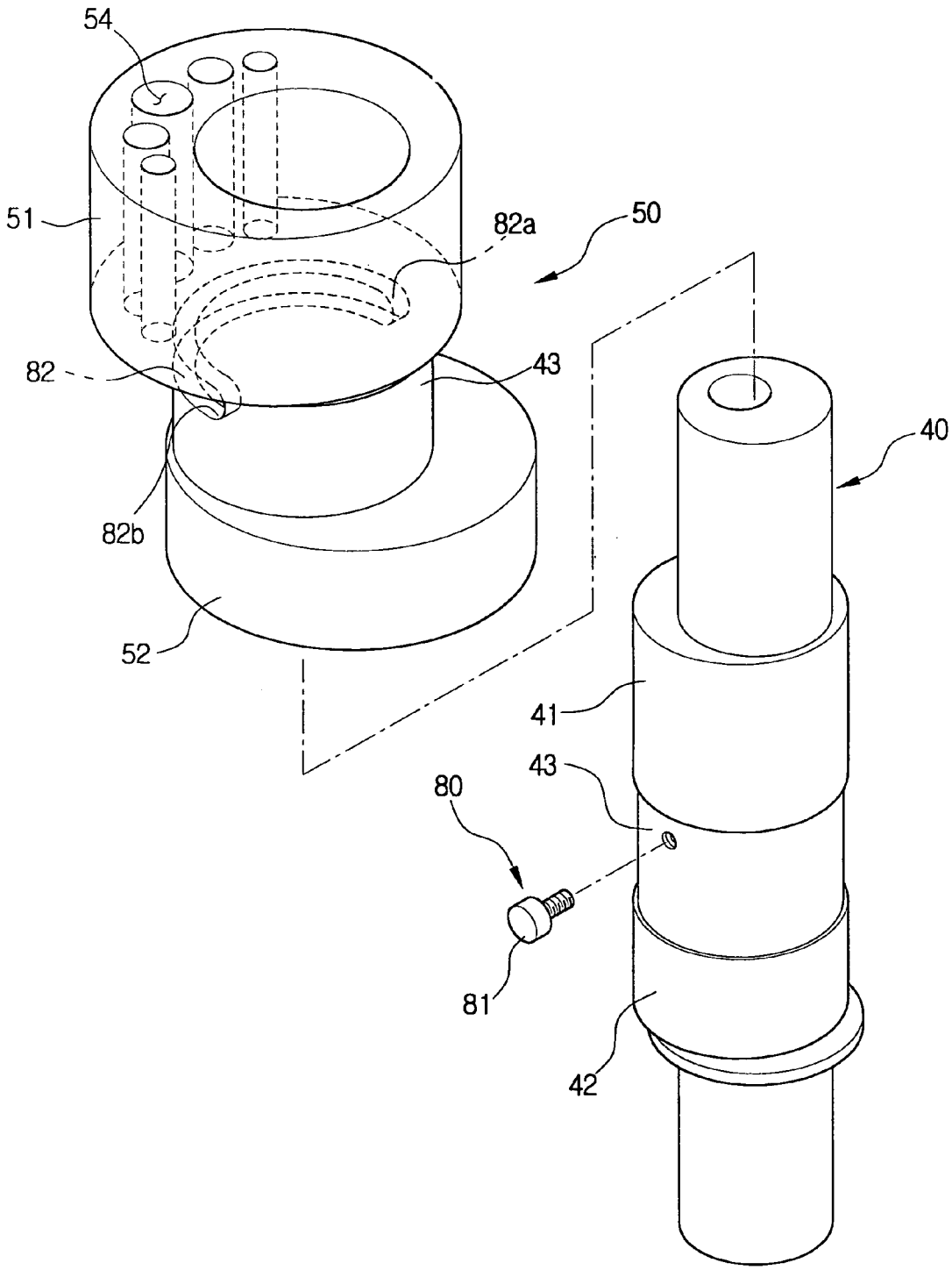
FIG. 8 is a perspective view to illustrate a rotating shaft and an eccentric unit included in a variable capacity rotary compressor, according to a second embodiment of the present invention.

According to the first embodiment, the plurality of through holes 54 and 55 are axially formed along the first and second eccentric bushes 51 and 52, respectively. However, without being limited to the embodiment, as illustrated in FIG. 8 to illustrate a second embodiment of the present invention, the plurality of through holes 54 may be axially formed along only the first eccentric bush 51 having the larger volume, thus reducing a weight difference between the first and second eccentric bushes 51 and 52. In this case, the center of gravity of the eccentric unit 50 is placed close to a center of the eccentric unit 50, thus reducing an axial distance between the center of gravity of the eccentric unit 50 and the first and second force transmission parts 82*a* and 82*b*, therefore allowing the eccentric unit 50 to be stably rotated.

The operation of the variable capacity rotary compressor according to the present invention will be described in the following in detail.

Figure 4:
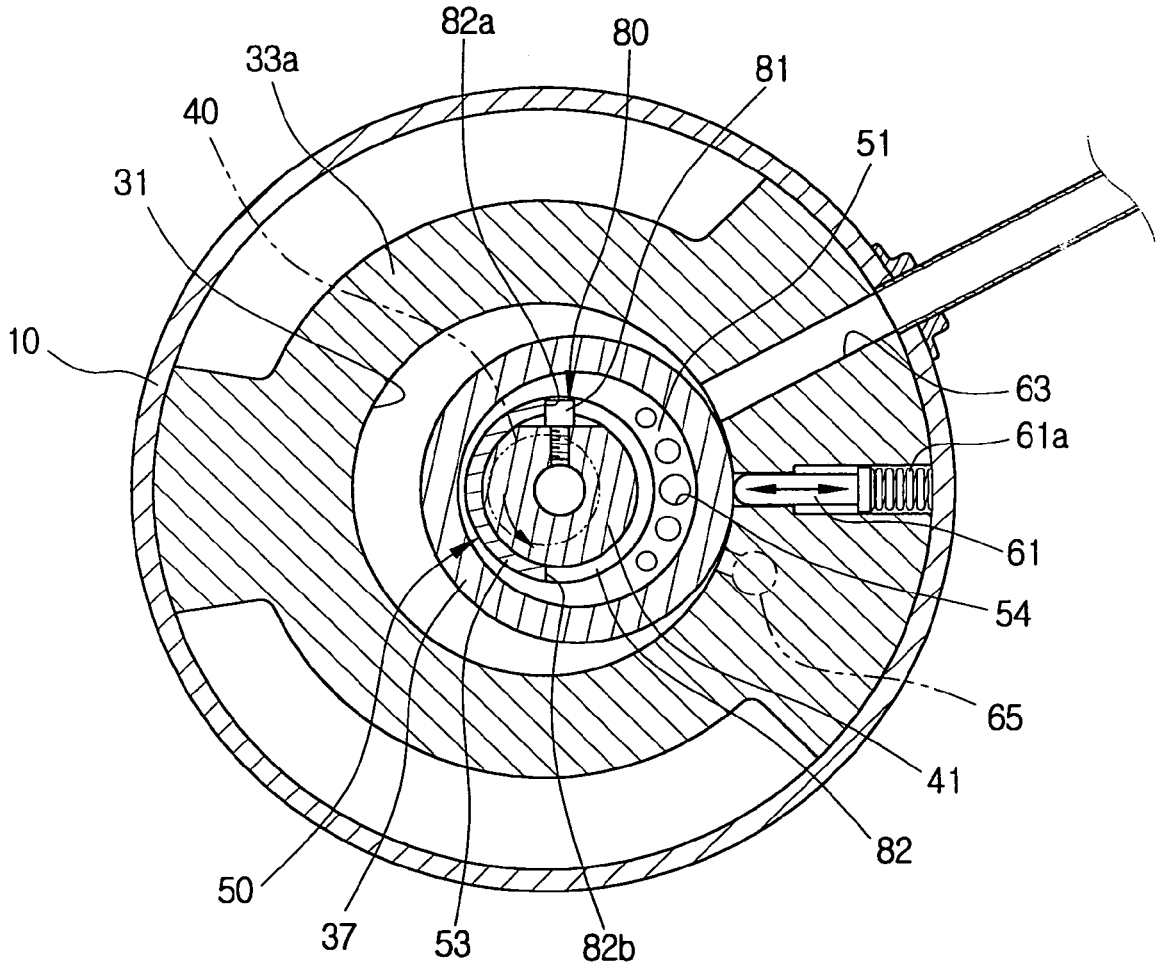
FIG. 4 is a sectional view to illustrate a compression operation of a first compression chamber, when the rotating shaft is rotated in a first direction.

When the rotating shaft 40 is rotated in a first direction by the drive unit 20, as illustrated in FIG. 4, an outer surface of the first eccentric bush 51 in the first compression chamber 31 is eccentric from the rotating shaft 40 and the locking pin 81 is locked by the first force transmission part 82*a* of the locking slot 82. Thus, the first roller 37 is rotated while coming into contact with an inner surface of the first compression chamber 31, thus executing the compression operation in the first compression chamber 31.

Figure 5:
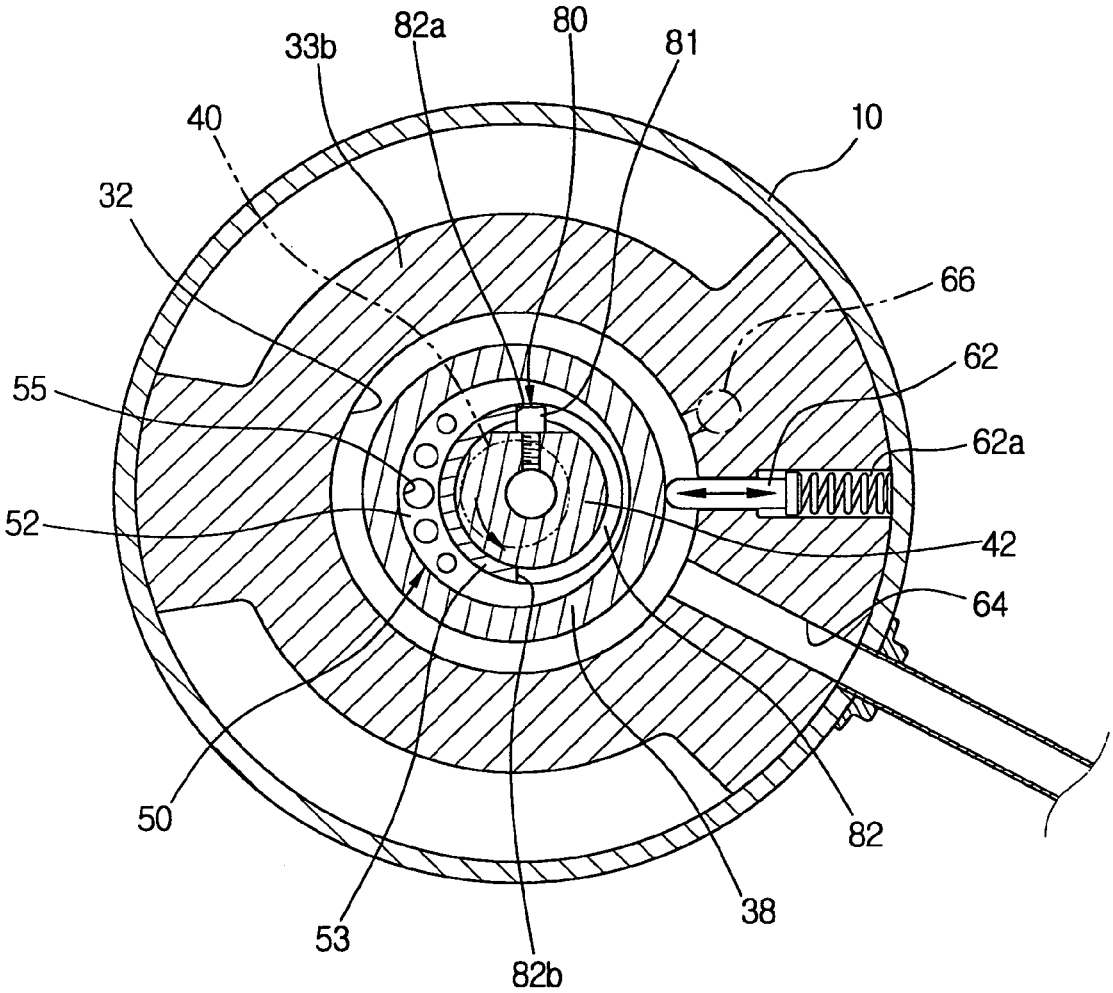
FIG. 5 is a sectional view to illustrate an idle operation of a second compression chamber, when the rotating shaft is rotated in the first direction.

Meanwhile, in the second compression chamber 32 where the second eccentric bush 52 is placed, an outer surface of the second eccentric bush 52, which is eccentric in a direction opposite to the first eccentric bush 51, is concentric with the rotating shaft 40, and the second roller 38 is spaced apart from an inner surface of the second compression chamber 32, as illustrated in FIG. 5, thus the idle operation is executed in the second compression chamber 32. When the compression operation is executed in the first compression chamber 31, the refrigerant is delivered into the inlet port 63 of the first compression chamber 31. Thus, the path control unit 70 is operated to control the path so that the refrigerant is delivered into only the first compression chamber 31.

The above-mentioned operation of the-variable capacity rotary compressor is a result of the fact that the first and second eccentric parts 41 and 42 are eccentric from the rotating shaft 40 in the same direction, and the first and second eccentric bushes 51 and 52 are eccentric from the rotating shaft 40 in opposite directions. In a detailed description, when a maximum eccentric part of the first eccentric part 41 and a maximum eccentric part of the first eccentric bush 51 are placed in a same direction, a maximum eccentric part of the second eccentric part 42 and a maximum eccentric part of the second eccentric bush 52 are placed in opposite direction.

Figure 6:
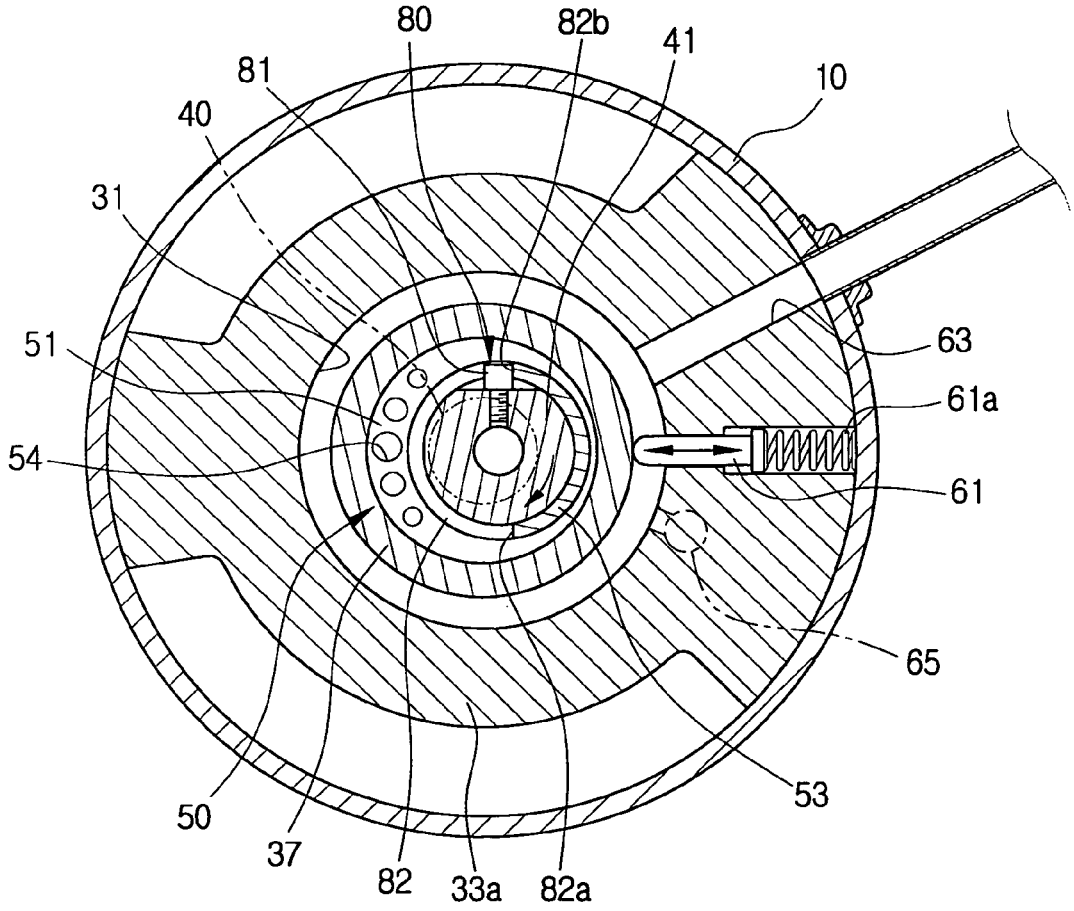
FIG. 6 is a sectional view to illustrate an idle operation of the first compression chamber, when the rotating shaft is rotated in a second direction.

Conversely, when the rotating shaft 40 is rotated in a second direction, as illustrated in FIG. 6, the outer surface of the first eccentric bush 51 in the first compression chamber 31 is released from the eccentricity from the rotating shaft 40 and the locking pin 81 is locked by the second force transmission part 82*b* of the locking slot 82. Thus, the first roller 37 is rotated while being spaced apart from the inner surface of the first compression chamber 31, so that the idle rotation of the first roller 37 is executed in the first compression chamber 31 without compressing the refrigerant.

Figure 7:
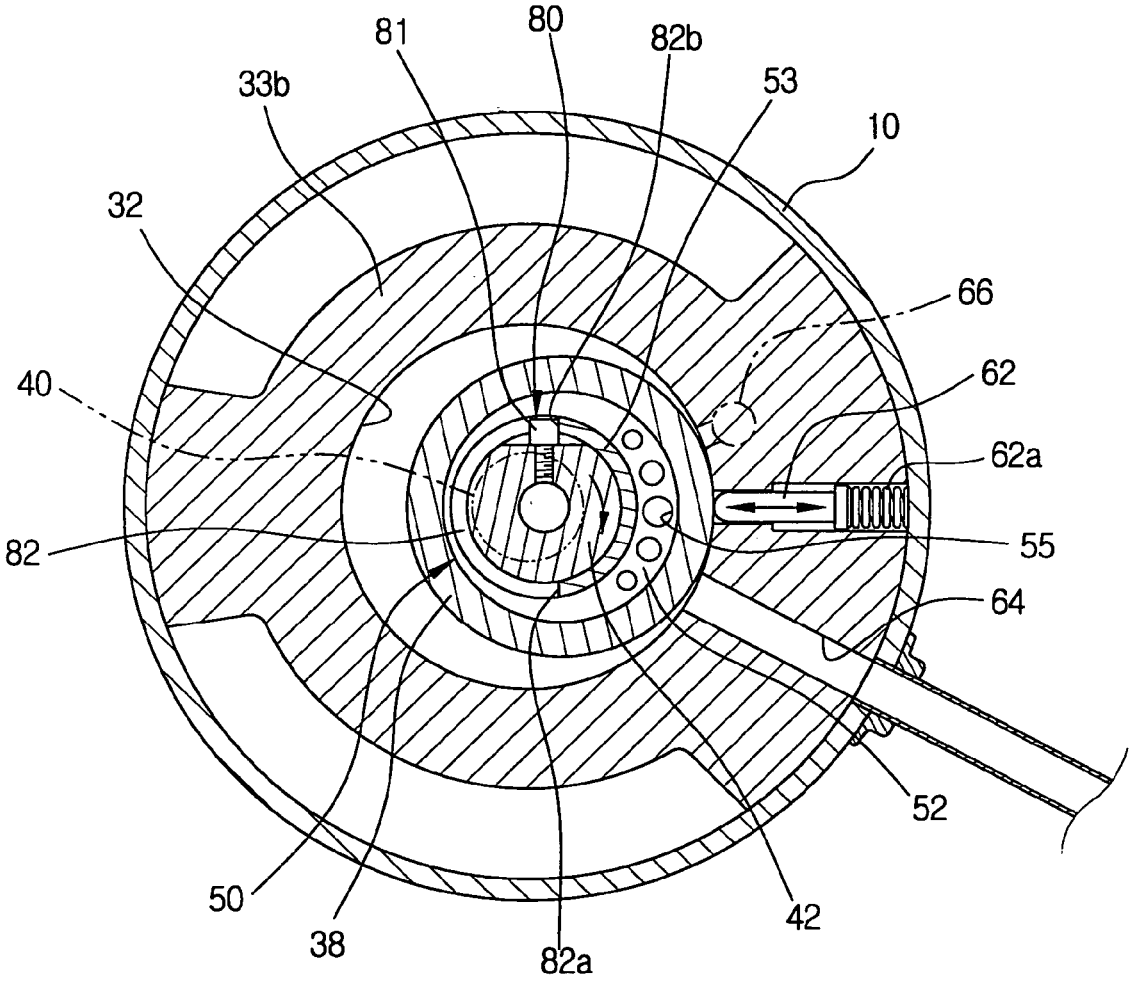
FIG. 7 is a sectional view to illustrate a compression operation of the second compression chamber, when the rotating shaft is rotated in the second direction.

Meanwhile, in the second compression chamber 32 where the second eccentric bush 52 is placed, the outer surface of the second eccentric bush 52 is eccentric from the rotating shaft 40, and the second roller 38 is rotated while being in contact with the inner surface of the second compression chamber 32, as illustrated in FIG. 7, thus the compression operation is executed in the second compression chamber 32.

When the compression operation is executed in the second compression chamber 32, the refrigerant is delivered into the inlet port 64 of the second compression chamber 32. Thus, the path control unit 70 controls the path so that the refrigerant is delivered into only the second compression chamber 32.

Since the first and second force transmission parts 82*a* and 82*b* of the locking slot 82 are placed to be adjacent to the first eccentric bush 51 which has a greater volume and hence is heavier than the second eccentric bush 52, the axial distance between the first and second force transmission parts 82*a* and 82*b* and the center of gravity of the eccentric unit 50 is very short or becomes zero. Thus, when the rotating force of the rotating shaft 40 is transmitted to the eccentric unit 50 through the first and second force transmission parts 82*a* and 82*b* so as to compress the refrigerant, the eccentric unit 50 is rarely tilted, thus considerably reducing the collision between the eccentric unit 50 and the compression chambers 31 and 32 and/or between the eccentric unit 50 and the rotating shaft 40.

As is apparent from the above description, the present invention provides a variable capacity rotary compressor of which force transmission parts are placed to minimize an axial distance between a center of gravity of an eccentric unit and the force transmission parts which receive a rotating force of a rotating shaft, thus reducing a tilt of the eccentric unit, therefore preventing a collision between the eccentric unit and compression chambers and/or between the eccentric unit and the rotating shaft.

Although a few embodiments of the present invention have been illustrated and described, it would be appreciated by those skilled in the art that changes may be made in this embodiment without departing from the principles and spirit of the invention, the scope of which is defined in the claims and their equivalents.

What is claimed is:

1. A variable capacity rotary compressor, comprising:

a housing to define therein a the first compression chamber having a first capacity, and a second compression chamber having a second capacity;

a rotating shaft to transmit a rotating force to the first and second compression chambers;

first and second eccentric parts, provided on an outer surface of the rotating shaft in the first and second compression chambers, respectively;

an eccentric unit, including first and second eccentric bushes having different weights, the first and second eccentric bushes fitted over the first and second eccentric parts, respectively, to rotate relative to the rotating shaft within predetermined angles; and a pair of force transmission parts provided on opposite sides of the eccentric unit to receive the rotating force of the rotating shaft so that one of the first and second eccentric bushes rotates the rotating shaft and a remaining one of the first and second eccentric bushes rotates while being released from eccentricity from the rotating shaft, according to a rotating direction of the rotating shaft, the pair of force transmission parts being provided to be closer to a center of gravity of the first or second eccentric bush which is heavier, than to a center of gravity of the first or second eccentric bush which is lighter.

2. The variable capacity rotary compressor according to claim 1, further comprising:

a locking slot provided around a predetermined portion of the eccentric unit so that opposite ends of the locking slot are placed on the opposite sides of the eccentric unit to serve as the pair of force transmission parts; and a locking pin projected from the outer surface of the rotating shaft to engage with the locking slot.

3. The variable capacity rotary compressor according to claim 1, wherein the pair of force transmission parts have axial positions aligned with an axial position of a center of gravity of the eccentric unit.

4. The variable capacity rotary compressor according to claim 1, further comprising a through hole which is axially provided along at least one of the first and second eccentric bushes, thus reducing an eccentric weight of the eccentric bush.

5. A variable capacity rotary compressor, comprising:

a housing to define a first compression chamber having a first capacity, and a second compression chamber having a second capacity;

a rotating shaft to transmit a rotating force to the first and second compression chambers;

first and second eccentric parts, provided on an outer surface of the rotating shaft, in the first and second compression chambers, respectively;

an eccentric unit comprising first and second eccentric bushes having different volumes, the first and second eccentric bushes fitted over the first and second eccentric parts, respectively, to rotate relative to the rotating shaft within predetermined angles; and a through hole axially provided along the first or second eccentric bush having a higher volume, thus reducing a weight difference between the first and second eccentric bushes.

6. A variable capacity rotary compressor, including a housing having first and second compression chambers having different capacities, and a rotating shaft to transmit a rotating force from a drive unit to the first and second compression chambers, comprising:

first and second eccentric parts on an outer surface of the rotating shaft and placed in the first and second compression chambers, respectively;

an eccentric unit, including first and second eccentric bushes made of similar materials and having different volumes, fitted over the first and second eccentric parts, respectively, to rotate relative to the rotating shaft; and force transmission parts to selectively rotate one of the eccentric bushes eccentrically and the other eccentric bush non-eccentrically, relative to the rotating shaft, according to a rotating direction of the rotating shaft, wherein the force transmission parts are closer to a center of gravity of the eccentric bush having the larger volume.

7. The variable capacity rotary compressor according to claim 6, further comprising:

a locking slot provided around a predetermined portion of the eccentric unit so that opposite ends of the locking slot are placed on the opposite sides of the eccentric unit to serve as the pair of force transmission parts; and a locking pin projected from the outer surface of the rotating shaft to engage with the locking slot.

8. The variable capacity rotary compressor according to claim 6, wherein the pair of force transmission parts are aligned along an axial direction of the eccentric unit proximate to a center of gravity of the eccentric unit.

9. The variable capacity rotary compressor according to claim 6, further comprising a through hole which is provided along an axial direction of at least one of the first and second eccentric bushes to reduce an eccentric weight of the eccentric bush.

10. A variable capacity rotary compressor, including a housing having a first compression chamber having a first capacity, and a second compression chamber having a second capacity, and a rotating shaft to transmit a rotating force from a drive unit which generates the rotating force to the first and second compression chambers, comprising:

first and second eccentric parts provided on an outer surface of the rotating shaft to be placed in the first and second compression chambers, respectively;

an eccentric unit, including first and second eccentric bushes made of similar materials and having different volumes, fitted over the first and second eccentric parts, respectively, to rotate relative to the rotating shaft within predetermined angles; and a through hole extending axially along the eccentric bush having a larger volume, to reduce a weight difference between the first and second eccentric bushes.

11. A variable capacity rotary compressor, including a housing having first and second compression chambers having different capacities, and a rotating shaft to transmit a rotating force from a drive unit to the first and second compression chambers, comprising:

first and second eccentric parts provided on the rotating shaft to be placed in the first and second compression chambers, respectively;

an eccentric unit, including first and second eccentric bushes made of similar materials and having different volumes, fitted over the first and second eccentric parts, respectively, to rotate relative to the rotating shaft within predetermined angles; and a through hole extending axially along the eccentric bush having a larger volume, to reduce a weight difference between the first and second eccentric bushes.

* * * * *

UNITED STATES PATENT AND TRADEMARK OFFICE

CERTIFICATE OF CORRECTION

PATENT NO. : 7,134,845 B2
APPLICATION NO. : 10/843303
DATED : November 14, 2006
INVENTOR(S) : Moon Joo Lee et al.

It is certified that error appears in the above-identified patent and that said Letters Patent is hereby corrected as shown below:

On the Title page:

(57) Abstract, Col. 2, line 3, change “transmit ting” to --transmitting--

In the Claims:

Col. 8, line 25, delete “the” before “first”

Signed and Sealed this

Twenty-seventh Day of March, 2007

JON W. DUDAS
*Director of the United States Patent and Trademark Office*